US007293849B2

(12) United States Patent
Tani et al.

(10) Patent No.: US 7,293,849 B2
(45) Date of Patent: Nov. 13, 2007

(54) INK JET RECORDING APPARATUS AND INK JET RECORDING METHOD

(75) Inventors: Mihoko Tani, Tokyo (JP); Takatsugu Doi, Ebina (JP); Eisuke Hiraoka, Ebina (JP); Ken Hashimoto, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 325 days.

(21) Appl. No.: 11/064,340

(22) Filed: Feb. 23, 2005

(65) Prior Publication Data

US 2006/0061620 A1 Mar. 23, 2006

(30) Foreign Application Priority Data

Sep. 22, 2004 (JP) ..... 2004-276166

(51) Int. Cl.

| | |
|---|---|
| ***B41J 29/38*** | (2006.01) |
| ***B41J 2/015*** | (2006.01) |
| ***B41J 2/165*** | (2006.01) |
| ***B41J 2/175*** | (2006.01) |

(52) U.S. Cl. ..... 347/6; 347/21; 347/29; 347/85

(58) Field of Classification Search ..... 347/6, 347/7, 20, 21, 29, 30, 32, 85, 89
See application file for complete search history.

(56) References Cited

U.S. PATENT DOCUMENTS 3,761,953 A * 9/1973 Helgeson et al. ..... 347/7
6,378,973 B1 4/2002 Kubota et al.

FOREIGN PATENT DOCUMENTS

| | | |
|---|---|---|
| JP | 57-061576 | 4/1982 |
| JP | 2000-168103 | 6/2000 |
| JP | 2000-272144 | 10/2000 |
| JP | 2002-019104 | 1/2002 |
| JP | 2002-019154 | 1/2002 |
| JP | 2002-086763 | 3/2002 |
| JP | 2002-200771 | 7/2002 |

* cited by examiner

*Primary Examiner*—Shih-wen Hsieh
(74) *Attorney, Agent, or Firm*—Fildes & Outland, P.C.

(57) ABSTRACT

An ink jet recording apparatus is provided with a recording head that ejects ink droplets, an ink tank that supplies ink to the recording head, a waste ink recovering mechanism that recovers ink droplets ejected from the recording head as waste ink, a waste-ink tank, which is connected to the waste-ink recovering mechanism and stores the waste ink, a diluent tank which is communicated with the waste-ink tank and accommodates a diluent that dilutes the waste ink, and at least one of diluent supplier, that is, one of a first diluent supplier which supplies the diluent in the diluent tank to the waste-ink tank to make the conductivity of the waste ink in the waste-ink tank substantially the same as the conductivity of the ink stored in the ink tank and a second diluent supplier which supplies the diluent in the diluent tank to the waste-ink tank to make the specific gravity of the waste ink in the waste-ink tank substantially the same as the specific gravity of the ink stored in the ink tank. Further, an ink jet recording method uses this ink jet recording apparatus.

18 Claims, 5 Drawing Sheets

INK JET RECORDING APPARATUS AND INK JET RECORDING METHOD

CROSS-REFERENCE TO RELATED APPLICATION

This application claims priority under 35 USC 119 from Japanese Patent Application No. 2004-276166, the disclosure of which is incorporated by reference herein.

BACKGROUND OF THE INVENTION

1. Field of the Invention

The present invention relates to an ink jet recording apparatus in which an ink-jet recording head ejects ink droplets to record on a recording medium, and to an ink jet recording method in which the ink jet recording apparatus is used.

2. Description of the Related Art

An ink jet recording apparatus selectively ejects ink droplets from multiple nozzles while a recording head is reciprocally moved in main scanning directions and recording paper is conveyed in a sub-canning direction, so that characters and images are recorded on the recording paper. The recording head ejects the ink by using various actuators. For example, a method in which ink droplets are ejected from a nozzle that communicates with a pressure chamber by applying pressure to the pressure chamber with a vibrator plate by the use of a piezoelectric element, and a method in which, using a heat-generating element, ink droplets are ejected using heat generated by the heat-generating element, are known.

When ink jet recording apparatuses of these types are allowed to stand for a long time, moisture in the ink evaporates with the result that the ink dries via the nozzle of the recording head. Since the viscosity of the ink increases when the ink dries, the ink is no longer ejected under a normal ink-discharging pressure, which causes printing defects. For this reason, the recording head is covered with a cap when the apparatus is not used so as to prevent the ink from drying within the nozzle. However, this method is insufficient for solving the problem.

In order to solve this problem, (1) a method in which, while the recording head is withdrawn to a non-printing area, the ink within the nozzle is refreshed by discharging ink having increased viscosity (a purging operation) and (2) a method in which, in a non-driving state, the meniscus face is vibrated to a degree at which ink is not ejected so that the ink having an increased viscosity is stirred (application of preliminary waveform) have been disclosed (for example, see Japanese Patent Application Laid-Open (JP-A) No. 2002-019104, JP-A No. 57-061576 and JP-A No. 2000-168103).

In accordance with the method (1) above, when the ink recovered from the recording head is discarded without being reused, ink is wastefully used and frequent ink-cartridge replacements are required, resulting in disadvantages from the economic point of view.

For this reason, various techniques in which the waste ink is reused to prevent wasteful use of ink resources have been proposed (for example, see Japanese Patent Application Laid-pen (JP-A) No. 2000-272144, JP-A No. 2002-19154, JP-A No. 2002-86763 and JP-A No. 2002-200771). These conventional reusing methods relate to techniques for adjusting the viscosity of waste ink and for filtering the waste ink through a filter and, as such, techniques in which volatile components are replenished based upon conductivity and specific gravity when reusing the waste ink have not been disclosed.

The invention has been devised so as to solve the above-mentioned problems, and provides an ink jet recording apparatus and an ink jet recording method which can reuse waste ink derived from an ink jet recording head of an ink jet recording apparatus.

SUMMARY OF THE INVENTION

According to a first aspect of the present invention, an ink jet recording apparatus is provided, the apparatus comprising: a recording head that ejects ink droplets; an ink tank that supplies ink to the recording head; waste ink recovering mechanism that recovers the ink droplets ejected from the recording head as waste ink; a waste-ink tank which is connected to the waste ink recovering mechanism, and stores the waste ink; a diluent tank which communicates with the waste-ink tank, and accommodates a diluent that dilutes the waste ink; and at least one diluent supplier selected from a first diluent supplier which supplies the diluent in the diluent tank to the waste-ink tank so as to make the conductivity of the waste ink in the wasteink tank substantially the same as the conductivity of the ink stored in the ink tank and a second diluent supplier which supplies the diluent in the diluent tank to the waste-ink tank so as to make the specific gravity of the waste ink in the waste-ink tank substantially the same as the specific gravity of the ink stored in the ink tank.

According to a second aspect of the invention, an ink jet recording method is provided, and the method uses the ink jet recording apparatus as described above, and comprises: recovering the waste ink into the wasteink tank; supplying the diluent in the diluent-tank to the waste-ink tank so as to make the conductivity of the waste ink in the wasteink tank substantially the same as the conductivity of the ink stored in the ink tank by using the first diluent supplier; and/or supplying the diluent in the diluent-tank to the wasteink tank so as to make the specific gravity of waste ink in the waste-ink tank substantially the same as the specific gravity of the ink stored in the ink tank by using the second diluent supplier.

In accordance with the invention, it becomes possible to provide an ink jet recording apparatus that is capable of reusing the waste ink ejected from the ink-jet recording head of an ink jet recording apparatus, and an ink jet recording method for such a apparatus.

BRIEF DESCRIPTION OF THE DRAWINGS

Preferred embodiments of the present invention will be described in detail based on the following figures, wherein.

DETAILED DESCRIPTION OF THE INVENTION

Figure 1:
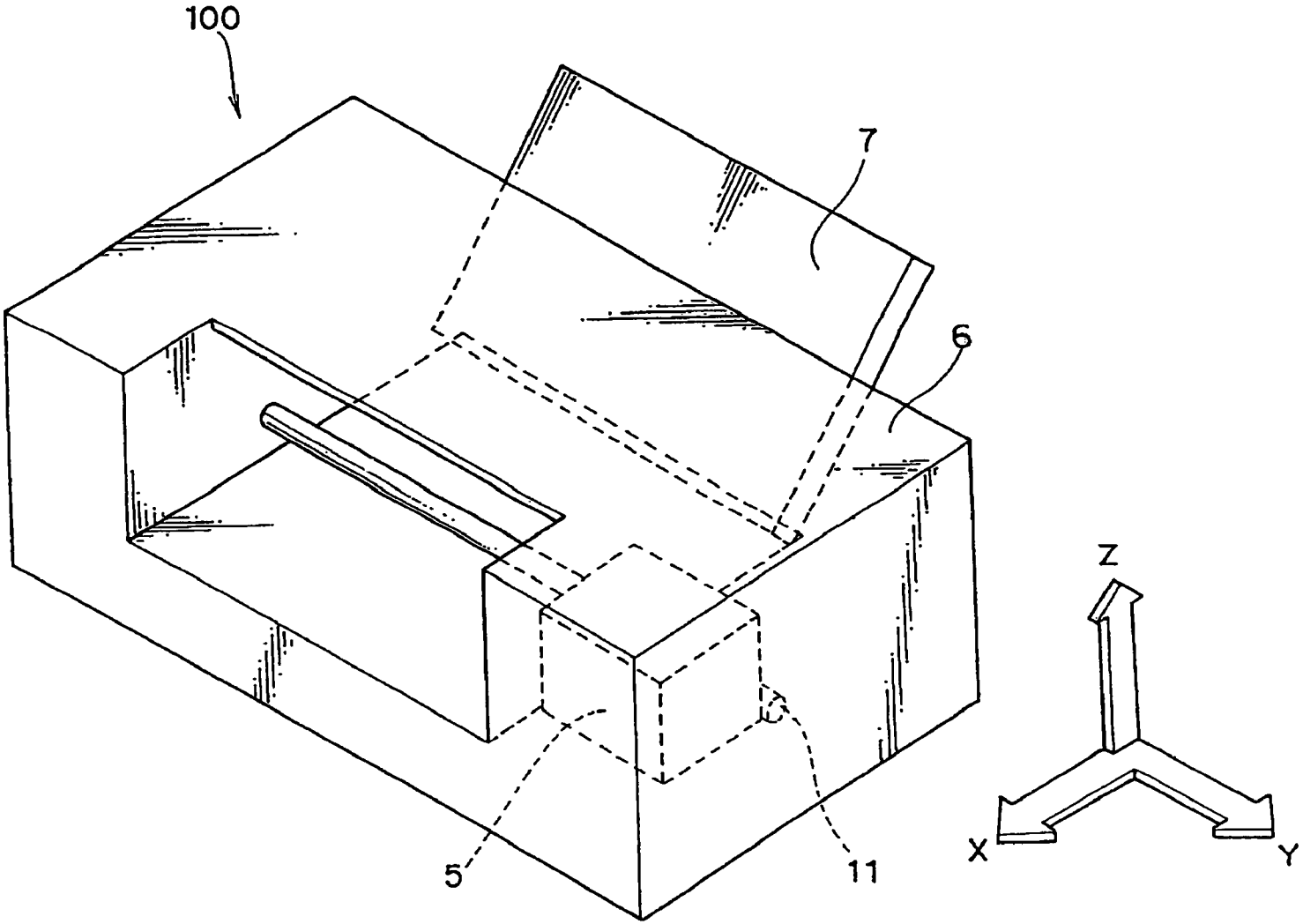
FIG. 1 is a perspective view that shows an external structure of a preferred embodiment of an ink jet recording apparatus in accordance with the invention.

An ink jet recording apparatus in accordance with the present invention is provided with a recording head that ejects ink droplets; an ink tank that supplies ink to the recording head; a waste ink recovering mechanism that recovers the ink droplets ejected from the recording head as waste ink; a waste-ink tank which is connected to the waste ink recovering mechanism, and stores the waste ink; a diluent tank which communicates with the waste-ink tank, and accommodates a diluent that dilutes the waste ink; and at least one diluent supplier selected from a first diluent supplier which supplies the diluent in the diluent tank to the waste-ink tank so as to make the conductivity of the waste ink in the wasteink tank substantially the same as the conductivity of the ink stored in the ink tank and a second diluent supplier which supplies the diluent in the diluent tank to the wasteink tank so as to make the specific gravity of the waste ink in the waste-ink tank substantially the same as the specific gravity of the ink stored in the ink tank.

An ink jet recording method in accordance with the invention, which used the ink jet recording apparatus as described above, and comprises: recovering the waste ink into the waste-ink tank; supplying the diluent in the diluent-tank to the waste-ink tank so as to make the conductivity of the waste ink in the waste-ink tank substantially the same as the conductivity of the ink stored in the ink tank by using the first diluent supplier; and/or supplying the diluent in the diluent-tank to the wasteink tank so as to make the specific gravity of waste ink in the waste-ink tank substantially the same as the specific gravity of the ink stored in the ink tank by using the second diluent supplier.

The following description will first discuss the ink jet recording apparatus of the invention in detail, and then discuss an ink jet recording method of the invention in association with the ink jet recording apparatus.

Referring to drawings, the structure and operations of an ink jet recording apparatus are generally explained. Here, in the drawings, those parts having substantially the same functions and/or structures are indicated by the same reference numerals, and the overlapping descriptions will be omitted.

Figure 2:
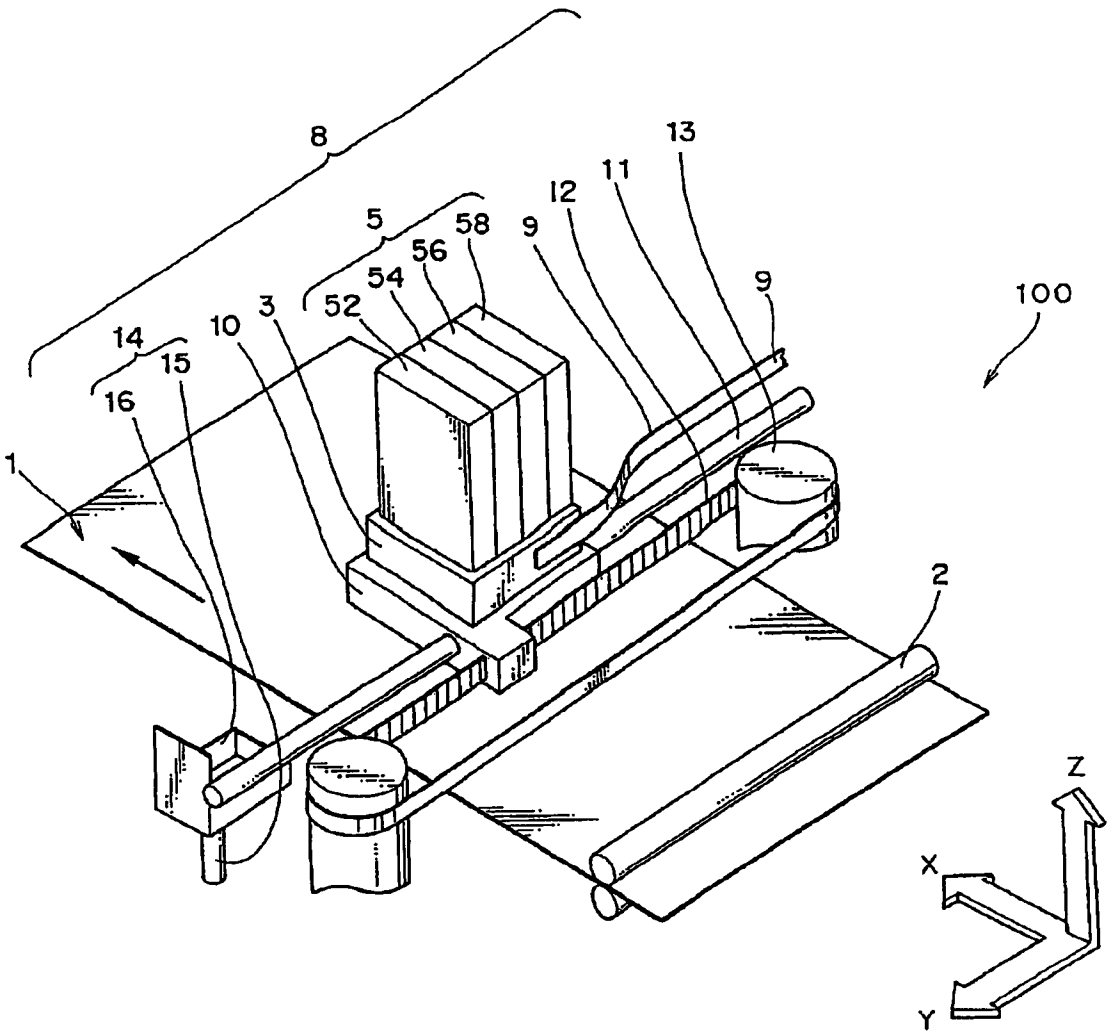
FIG. 2 is a perspective view that shows the basic structure of the inside of the ink jet recording apparatus of FIG. 1.

FIG. 1 is a perspective view that shows an external structural view of an ink jet recording apparatus. FIG. 2 is a perspective view that shows an internal basic structure of the ink jet recording apparatus of FIG. 1. The ink jet recording apparatus 100 of the present embodiment is operated based upon the ink jet recording method of the invention to form an image. In other words, as shown in FIGS. 1 and 2, the ink jet recording apparatus 100 is mainly constituted by an external cover 6, a tray 7 on which a predetermined number of recording media 1, such as sheets of regular paper, are placed, transport rollers (transport means) 2 used for transporting the recording media 1 into the ink jet recording apparatus 100 sheet by sheet, and an image-forming unit 8 (image-forming means), which ejects ink and a liquid composition onto a surface of the recording medium 1 to form an image thereon.

The transport rollers 2, which are a pair of rollers that are rotatably placed in the ink jet recording apparatus 100, sandwich the recording medium 1 set on the tray 7, and transport the predetermined sheets of the recording media 1 into the apparatus 100 sheet by sheet in predetermined timing.

The image-forming unit 8 forms an image on the surface of the recording medium 1 by using ink. The image-forming unit 8 is mainly constituted by a recording head 3, an ink tank (liquid-storing-use cartridge) 5, a power-supply signal cable 9, a carriage 10, a guide rod 11, a timing belt 12, a driving pulley 13 and a maintenance unit 14.

The ink tank 5 is constituted by four ink tanks 52, 54, 56 and 58, which store respective inks or liquid compositions having different colors so as to be ejected. The inks and liquid compositions are housed in these ink tanks.

As shown in FIG. 2, the power-supply and signal cable 9 and the ink tank unit 5 are connected to the recording head 3, and when external image-recording information is inputted via the power-supply and signal cable 9 to the recording head 3, the recording head 3 sucks a particular amount of ink from each of the ink tanks which ejects onto the recording medium according to this image-recording information. In addition to the image-recording information, the power-supply and signal cable 9 also functions to supply to the recording head 3 the power necessary for driving the recording head 3.

Further, the recording head 3 is placed and held on the carriage 10, and the guide rod 11 and the timing belt 12 connected to the driving pulleys 13 are connected to the carriage 10. In such a configuration, the recording head 3 is continuously movable along the guide rod 11, parallel to the surface of the recording medium 1 and in a direction perpendicular to the traveling direction X (sub-canning direction) of the recording medium 1.

The recording apparatus 100 is also equipped with a controller (not shown) for controlling the drive timing of the recording head 3 and the carriage 10 based on the image-recording information. Consequently, the apparatus can form images continuously in a particular region on the surface of the recording medium 1 conveyed at a certain speed in the traveling direction X, based on the image recording information.

The maintenance unit (waste ink recovering mechanism) 14 is constituted by at least a cap member 16 that recovers ink in the recording head 3, a pressure-reducing device (not shown) and a tube 15 that connects the cap member 16 and the pressure-reducing device with each other. Further, the maintenance unit 14 is connected to a nozzle portion of the recording head 3, which has moved to the maintenance unit 14 for maintenance operation, so that the pressure within the nozzle of the recording head 3 is reduced so that ink is drawn from the nozzle of the recording head 3. The maintenance unit 14 is installed so that during the operation of the ink jet recording apparatus 100, if necessary, excessive ink adhered to the nozzle can be removed, and evaporation of the ink from the nozzle can be suppressed during the operation stop state.

The structure and functions of the maintenance unit 14 will be described hereinafter in detail.

Figure 3:
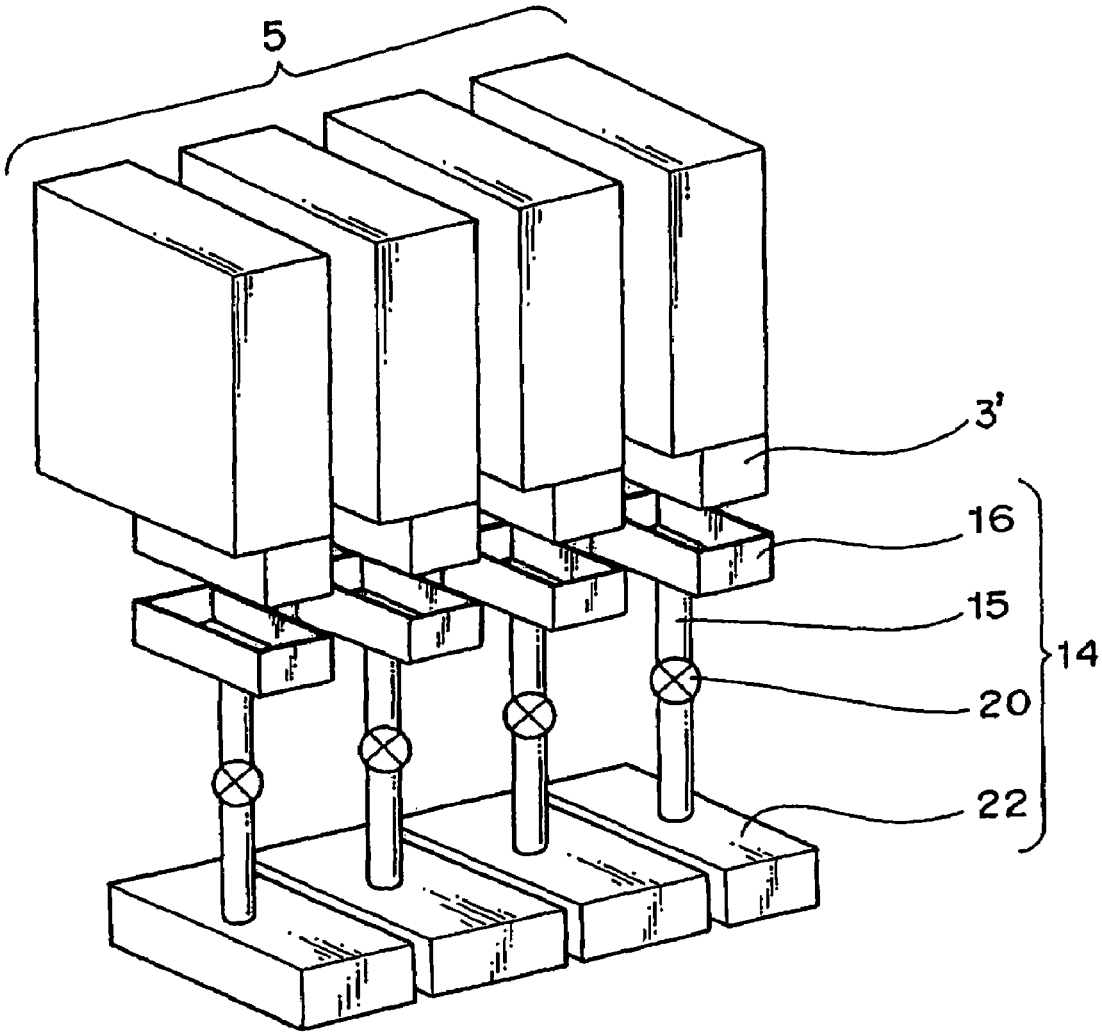
FIG. 3 is a schematic perspective view that shows a schematic structure of one mode of a maintenance unit to be installed in the ink jet recording apparatus in accordance with the invention.

FIG. 3 is a schematic perspective view that shows an embodiment of a maintenance unit which is installed in the ink jet recording apparatus of the present invention.

As shown in FIG. 3, the maintenance unit 14 is provided with four cap members 16 corresponding to nozzle faces of recording heads (recording heads 3') which respectively correspond to four tanks that constitute an ink tank unit 5, and one end of each of four tubes 15 connected to these cap members 16 respectively. The other end of each of the tubes 15 is connected to each of four waste-ink tanks (wastesolution reservoir) 22. Moreover, a pressure reducing device 20, such as a suction pump (in which reference numeral 20 indicates only the portion of the inlet of the pressure reducing device), is connected to each of the tubes 15. Here, the ink tank 5 and the recording head 3, shown in FIG. 2, are illustrated in divided states in FIG. 3, in a different manner from those of FIG. 2, in order to make explanation simpler.

During maintenance work, in the state where the cap member 16 corresponding to the recording head 3' is brought into contact with the nozzle face, and pressure of the inside of the nozzle of the recording head 3' is reduced so that the ink is drawn and collected into the respective waste-ink tanks 22 through the tubes 15.

As described above, the recording head is provided with liquid storing cartridges that accommodate normally two kinds of liquids or more, respectively, and is generally adapted to eject the respective liquids from different nozzles. In this case, at least one kind of liquid stored in the corresponding liquid storing cartridge is used for ink for printing, and the other kind of liquid is used for a liquid composition for preventing coagulation and thickening of the liquid. Specific examples thereof include a recording head having a liquid-storing cartridge accommodating a liquid composition therein, in addition to ink storing cartridges for accommodating cyan, magenta, yellow and black inks, respectively. A recording head have been described as a form integrated with ink tanks as a preferable embodiment. However, the recording head and the ink tank may be separated from each other and connected to each other through a communicating pipe.

It is possible to carry out maintenance work for the recording head by utilizing a conventionally known method in the non-printing state using the waste ink recovering mechanism. For example, in the case when ink inside the nozzle of the recording head is removed by utilizing dummy jet in the non-printing state, after the recording head has been shifted to a position at which the ejected ink can be collected into the waste-ink tank by the waste ink recovering mechanism, the ink is ejected (dummy jet).

Alternatively, in the case when ink is drawn and ejected by suction using a waste ink processing mechanism in the non-printing state, the ink within the nozzle of the recording head may be withdrawn and collected into the waste-ink tank through a cap member connected to the waste-ink tank through a suction pump and a tube. Here, this cap member is placed so as to be made in close-contact with the nozzle face of the recording head that has been shifted to a maintenance section when a maintenance work is carried out.

Moreover, in addition to the above-mentioned discharging process of the printing ink within the nozzle by the use of dummy jet or suction, a wiper, which wipes the nozzle face of the recording head that has been shifted to the maintenance section when a maintenance work is carried out, may be provided so as to clean stains on the nozzle face. Furthermore, when a maintenance work carried out, a plurality of conventionally known recording-head maintenance methods, such as the dummy jet, suction and wiping methods, may be combined so as to carry out the maintenance work.

The above explanation has been made in connection with general features relating to the present invention. With respect to a combination (structure shown in FIG. 3) of the ink tank, recording head and waste ink recovering mechanism in the above-described ink jet recording apparatus, the structure of the invention further includes a diluent tank that communicates with a waste-ink tank, and stores a diluent for diluting the waste ink and a diluent supplier that supplies the diluent to the waste-ink tank. The diluent supplier includes at least either one of a first diluent supplier and a second diluent supplier.

In the ink jet recording apparatus of the present invention, the waste ink, in which volatile components in the ink have been evaporated, is diluted by the diluent so as to allow the waste ink to have substantially the same properties of the original ink before the volatile components is evaporated, and the resulting diluted ink (hereinafter, sometimes referred to as "reuse ink") is reused. Here, in the first diluent supplier, the "conductivity" as a measure of the quantity of the diluent to be added to the waste ink to recover (substantially recover) the original properties of the ink is used, and in the second diluent supplier, the "specific gravity" as a measure thereof. This is based on the fact that the conductivity and specific gravity of the ink before evaporation of the volatile components are different from those after evaporation of the ink. In other words, even when the volatile components have evaporated to form waste ink, the diluent in an amount set based upon the conductivity and/or the specific gravity of the waste ink is added to the waste ink so that the conductivity or the specific gravity is returned to the same level as that of the ink before evaporation, and thus, the resultant ink can be reused.

The diluent to be stored in the diluent tank includes water and an organic solvent. With respect to the diluent, water and/or a volatile organic solvent having a vapor pressure of not less than 2.66 kPa (20 mmHg) at 25° C. are preferably used. Water or the organic solvent is normally contained in the ink, and the waste ink is returned to its original state by replenishing this volatile component to the waste ink to be reused.

Moreover, of course, the diluent preferably contains the same components as the volatile components contained in the ink, in order to dilute the waste ink to be substantially equal to the ink property originally stored in the ink tank.

Referring to drawings, an embodiment that uses the first diluent supplier in the ink jet recording apparatus of the present invention will be described hereinafter.

As described above, the first diluent supplier is used for supplying the diluent to the waste-ink tank so that the conductivity of the waste ink and that of the original ink are substantially the same. The waste ink has a higher viscosity and a lower conductivity relative to those of the ink within the ink tank due to evaporation of the volatile components. Therefore, the diluent corresponding to the quantity of the evaporated components is added to the waste ink so as to return it to the initial state. In order to make the conductivity of the waste ink and the conductivity of the ink identical to each other, the absolute detection that directly measures the conductivity of the waste ink may be used, or the relative detection with respect to the initial ink that does not directly measure the conductivity of the waste ink may be used. For example, the following (1) to (3) methods are exemplified; however, the invention is not intended to be limited by these methods.

(1) Both of the conductivity of the waste ink in the wasteink tank and the conductivity of the ink in the ink tank are measured so that the diluent is supplied to the waste-ink tank so as to make both of the conductivities substantially coincident with each other.

(2) Only the conductivity of the waste ink in the waste-ink tank is measured, and based upon the conductivity, the amount of the diluent to be supplied to the wasteink tank is determined. In this case, the relationship between the conductivity of the waste ink and the amount of the diluent to be supplied can be obtained by a calibration curve previously prepared, and in such a method, the amount of the diluent in association with the conductivity of the waste ink can be obtained in advance.

(3) Electrodes are installed in both of the wasteink tank and the ink tank, and the diluent is supplied to the wasteink tank until the conductivity of the waste ink becomes equal to the conductivity of the ink tank.

Here, the expression "substantially equal" does not necessarily mean that the conductivity of the waste ink in the wasteink tank is completely identical with that of the ink in the ink tank, but the conductivity of the waste ink becomes within a range of ±0.02 S/m of the conductivity of the ink, more preferably, within a range of ±0.01 S/m.

Figure 4:
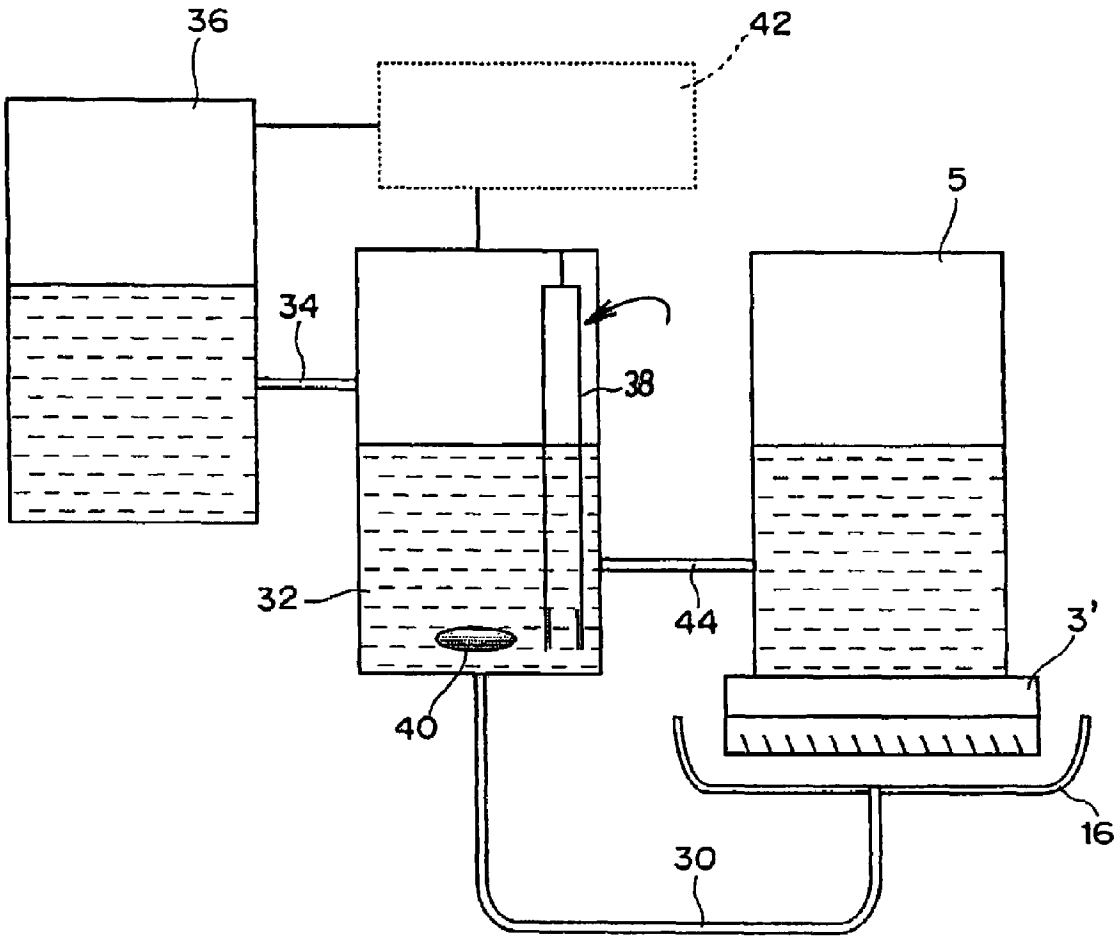
FIG. 4 is a schematic drawing that shows one example of a peripheral portion of a recording head including a first diluent supplier and an ink tank (corresponding to one color)

Referring to drawings, the embodiments of the present invention will be described hereinafter. FIG. 4 is a drawing that schematically shows one example of the relevant portions of a recording head including a first diluent supplier and an ink tank (corresponding to one color). In FIG. 4, components that are substantially the same as the components shown in FIGS. 1 to 3 are illustrated by the same reference numbers. A cap member 16 is disposed at a position facing the ink ejecting side of a recording head 3' attached to the ink ejecting outlet port of an ink tank 5, and the cap member 16 communicates with a waste-ink tank 32 through an ink supply path 30. The wasteink tank 32 further communicates with a diluent tank 36 through a diluent supply path 34. Here, the diluent supply path 34 is provided with a solenoid valve (not shown) that adjusts an amount of the diluent flowing into the wasteink tank 32 from the diluent tank 36. Thus, the amount of supply of the diluent from the diluent tank 36 to the wasteink tank 32 is adjusted by opening and closing the solenoid valve. Moreover, the waste-ink tank 32 communicates with the ink tank 5 through a reuse ink path 44 so that the reuse ink obtained by diluting the waste ink by the supplied diluent is returned to the ink tank 5 through the reuse ink path 44.

In the waste-ink tank 32, conductivity detection electrodes 38 are placed in such a manner that the tip ends of the electrodes are positioned below the liquid surface of the waste ink when the tank is filled with the waste ink to a predetermined level. When a fixed amount of the waste ink has been collected into the waste-ink tank 32 so that the tip ends of the conductivity detection electrodes 38 are immersed in the waste ink, an electric current is allowed to flow and the conductivity is detected.

The solenoid valve and the conductivity detection electrodes 38 are electrically connected to a measuring and controlling device 42, and based upon the electric current detected by the conductivity detection electrodes 38, the measuring and controlling device 42 controls the opening and closing operations of the solenoid valve so as to adjust the amount of supply of the diluent to the waste-ink tank 32.

The waste-ink tank may be provided with a solid-state member (float) 50 that floats on the liquid surface of the waste ink so as to detect the amount of waste ink that has been supplied. The position of the solid-state member is detected by an optical sensor so that the amount of the waste ink supplied to the waste-ink tank 32 can be detected. Further, the solid-state member may be designed so as to be driven to rotate, and may function as a stirring member 40 as described hereinafter.

Next, a recording method by the use of the ink jet recording apparatus of the present embodiment having the features described above will be described. First, the waste ink recovering mechanism is driven for maintenance or the like, and ink droplets, ejected from the recording head, are collected in the waste-ink tank 32 as waste ink. When a predetermined amount of waste ink has been stored in the waste-ink tank 32, the conductivity detection electrodes 38 energize the measuring and controlling device 42 to detect the conductivity so that the amount of the diluent corresponding to the detected conductivity is supplied to the waste-ink tank 32 from the diluent tank 36. Upon completion of the supply of the diluent, the stirring member 40 is rotated to stir the waste ink so as to be uniformly mixed; thus, the waste ink is returned to the waste-ink tank 5 through a reuse ink path 44 as a reuse ink, and again is utilized as a recording ink.

Next, referring to drawings, the embodiment in which the ink jet recording apparatus of the present invention is provided with a second diluent supplier will be described. The second diluent supplier is designed to supply the diluent to the waste-ink tank so that the specific gravity of the waste ink and the specific gravity of the ink are substantially identical to each other. Here, the specific gravity of the waste ink has an increased specific gravity as compared with the specific gravity of the ink in the ink tank due to evaporation of volatile components. Therefore, the diluent corresponding to the amount of evaporation of the volatile components is supplied to the waste ink so that it is returned to the initial state of the ink. Here, in order to make the specific gravities of the waste ink and the ink identical to each other, the absolute detection by measuring directly the specific gravity of the waste ink may be used, or the relative detection of the specific gravity of the waste ink relative to the initial ink that does not directly measure the specific gravity of the waste ink may be used. For example, the following (1) to (3) methods are exemplified. However, the present invention is not intended to be limited by these methods. Here, the detection of specific gravities can be carried out by allowing a solid-state member to float on the waste ink in the waste-ink tank to detect the position of the solid-state member for specific-gravity detection.

(1) Both of the specific gravity of the waste ink in the waste-ink tank and the specific gravity of the ink in the ink tank are measured so that the diluent is supplied to the wasteink tank so as to make both of the specific gravities substantially coincident with each other.

(2) Only the specific gravity of the waste ink in the wasteink tank is measured, and, the amount of the diluent to be supplied to the ink tank is determined based upon the specific gravity of the waste ink, and the amount of the diluent corresponding to the determined specific gravity is supplied to the waste-ink tank. In this case, the amount of the diluent relative to the specific gravity of the waste ink can be calculated in advance, from a calibration curve previously obtained based on the relationship between the specific gravity of the waste ink and the amount of the diluent and the like, (3) A solid-state member having a specific gravity higher than the specific gravity of the initial ink is placed in the wasteink tank so that the diluent is supplied until the solid-state member has been submerged in the waste-ink tank.

Here, the expression "substantially identical" does not necessarily mean that the specific gravity of the waste ink is completely the same as that of the ink, and the specific gravity of the waste ink is within a range of ±0.03 of the specific gravity of the ink, more preferably, within a range of ±0.02.

Figure 5:
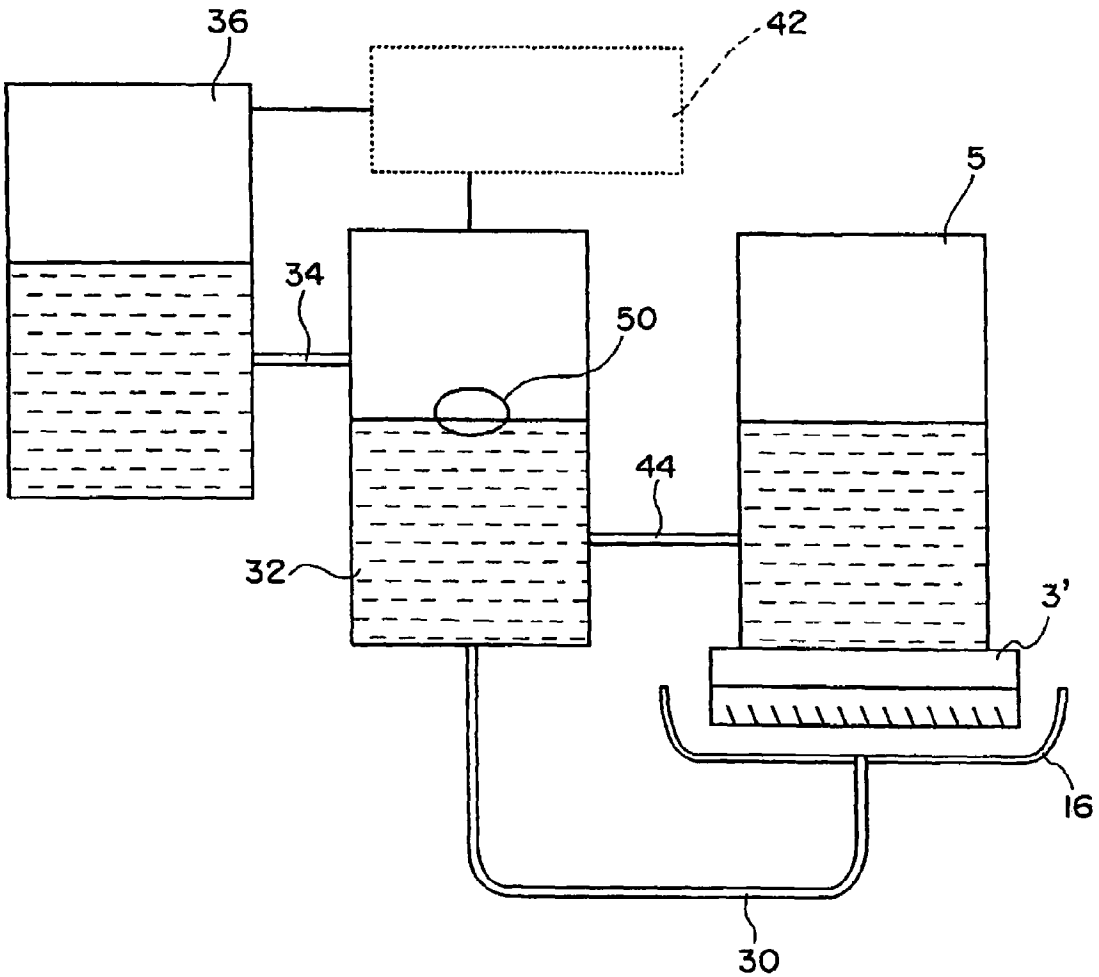
FIG. 5 is a schematic drawing that shows one example of a peripheral portion of a recording head including a second diluent supplier and an ink tank (corresponding to one color)

Referring to drawings, an embodiment of the present invention will be described. FIG. 5 is a drawing that schematically shows one example of the pertinent 1 portion of a recording head including a second diluent supplier and an ink tank (corresponding to one color). In FIG. 5, except for the structure of the waste-ink tank 32, the other features are the same as those shown in FIG. 4; therefore, only the waste-ink tank 32 will be explained.

A solid-state member (float) 50, used for detecting the specific gravity, is placed in the wasteink tank 32, and this member is maintained either in a floating state on the liquid surface of the waste ink, or in a submerged state in the liquid so that depending on the position (floating or submerged level) of the solid state member 50, the specific gravity of the waste ink is detected. The volatile components in the waste ink have been evaporated in comparison with the initial-state ink, and the waste ink has a higher specific gravity in comparison with the initial-state ink. Therefore, the solid-state member that floats on the liquid surface of the waste ink in the waste ink, and that submerges in the initial-state ink due to buoyant force, is selected and used, and it becomes possible to detect the position of the solid-state member 50, and consequently to supply the amount of the diluent corresponding to the detected position to the waste-ink tank.

The material for the solid-state member 50 is not specifically limited, but a resin material (such as, a polyethylene, polypropylene, polyester, polyamide, polystyrene or acrylic resin, a fluorine-based or silicone-based resin, and a copolymer thereof) dispersing magnetite, ferrite, iron and the like (preferably, having small residual magnetization) therein, and is light so as not to cause any problems upon contact with the ink, is preferably used. The solid-state member may be designed to have a hollow structure so as to adjust the specific gravity.

The detection of the solid-state member 50 can be carried out by using a detector such as an optical sensor. The positional detection method for an object by the use of the optical sensor has been conventionally known.

This embodiment using a recording method in which the ink jet recording apparatus having the above-mentioned features will be described hereinafter. First, the waste ink recovering mechanism is driven for maintenance or the like, and ink droplets, ejected from the recording head, are collected in the waste-ink tank 32 as waste ink. When a predetermined amount of waste ink has been stored in the wasteink tank 32, the measuring and controlling device 42 detects the position of the solid-state member 50 so that the amount of the diluent corresponding to the detected position is supplied to the wasteink tank 32 from the diluent tank 36. Upon completion of the supply of the diluent, the stirring member 40 is rotated to stir the waste ink so as to be uniformly mixed; thus, the waste ink is returned to the waste-ink tank 5 through a reuse ink path 44 as a reuse ink, and again utilized as a recording ink.

In any of the first embodiment and the second embodiment, the stirring member 40, driven to be rotated, and a means (not shown) for driving the stirring member 40 may be disposed in the wasteink tank 32 as members that are driven by external instructions, and by driving optionally the stirring member 40, the waste ink can be stirred. The timing for driving the stirring member 40 is preferably after the diluent has been supplied to the waste ink, and the waste ink can be uniformly mixed by driving the stirring member 40 in this timing. Moreover, it becomes possible to prevent sedimentation of pigments, and also to deaerate from the ink so as to prevent generation of bubbles.

Preferably, this type of the stirring member 40 is also disposed in the ink tank 5. This arrangement is particularly effective when the diluent is added to the waste ink to form a reuse ink which is mixed with the ink in the ink tank.

The material for the stirring member 40 is not specifically limited, but a resin material (such as, a polyethylene, polypropylene, polyester, polyamide, polystyrene or acrylic resin, a fluorine-based or silicone-based resin, and a copolymer thereof) dispersing magnetite, ferrite, iron and the like (preferably, having small residual magnetization) therein, and is light so as not to cause any problems upon contact with the ink, is preferably used.

With respect to the stirring member 40, those which are driven to rotate have been exemplified; however, any member, which is driven through an external instruction, that is, which carries out a stirring process, may be used. For example, a member, which carries out the stirring process by utilizing vibration of a piezoelectric element, may be used.

In any of the first and second embodiments, the structure such that the waste ink in the wasteink tank (that is, reuse ink) is not returned to the original ink tank, but another recording head different from that of the ink tank is attached to the waste-ink tank so that the waste-ink tank is used as a new ink tank may be adopted. Moreover, a filtering means, such as a filter, may be placed in the flow path of the reuse ink path 44.

In the ink jet recording apparatus of the invention, it is more preferable to install both of the first diluent supplier and the second diluent supplier from the viewpoint that the amount of addition of the diluent can be more precisely determined.

EXAMPLES

Example 1

First, ink (1) having the following composition of components is prepared.

(Ink Composition)

| | |
|---|---|
| Dye (anion-based cyan dye) | 5 parts by mass |
| Glycerin | 30 parts by mass |
| Surfactant (nonionic surfactant) | 1 part by mass |
| Pure water | rest of parts |

To this is further added a pH adjusting agent (BES/NaOH buffer) appropriately to set the pH value to pH7; thus, the ink (1) to be used in Example 1 is prepared.

The conductivity of the ink (1) thus prepared is 0.0309 S/m. Further, when the content of water is made approximately one half (from about 60 parts by mass to about 30 parts by mass), the conductivity of the ink having the above-mentioned components becomes 0.0198 S/m.

An ink cartridge is filled with the ink (1). This ink cartridge is attached to each of the ink jet recording apparatuses having the structures explained with reference to FIGS. 1 to 3 and FIG. 4, and solid images are printed. When the ink, ejected from the ink cartridge through a recording head, has been accumulated in the waste-ink tank as waste ink, the conductivity thereof is detected by conductivity detection electrodes so that a diluent is supplied from a diluent tank, resulting in the conductivity being 0.037 S/m. Then, the waste ink (reuse ink) which has been diluted is again returned to the ink tank so as to be reused.

Example 2

First, ink (2) having the following composition of components is prepared.

(Ink Composition)

| | |
|---|---|
| Pigment (self-dispersing carbon black) | 5 parts by mass |
| Glycerin | 25 parts by mass |
| 2-pyrrolidone | 5 parts by mass |
| Surfactant (nonionic surfactant) | 1 part by mass |
| Pure water | rest of parts |

To this is added a pH adjusting agent (BES/NaOH buffer) appropriately to set the pH value to pH7; thus, the ink (2) to be used in Example 2 is prepared.

The conductivity of the ink (2) thus prepared is 0.213 S/m. Further, when the content of water is made approximately one half (from about 65 parts by mass to about 30 parts by mass), the conductivity of the ink having the above-mentioned components becomes 0.187 S/m.

An ink cartridge is filled with the ink (2). This ink cartridge is attached to each of the ink jet recording apparatuses having the structures explained with reference to FIGS. 1 to 3 and FIG. 4, and solid images are printed. When the ink, ejected from the ink cartridge through a recording head, has been accumulated in the waste-ink tank as waste ink, the conductivity thereof is detected by conductivity detection electrodes so that a diluent is supplied from a diluent tank so that the conductivity is set to 0.197 S/m. Then, the waste ink (reuse ink) which has been diluted is again returned to the ink tank so as to be reused.

Example 3

The ink (1) used in Example 1 is prepared, and the specific gravity thereof is measured and found to be 1.07. When the content of water is made approximately one half (from about 60 parts by mass to about 30 parts by mass), the specific gravity of the ink having the above-mentioned components becomes 1.13.

An ink cartridge is filled with the ink (1), and this ink cartridge is attached to each of the ink jet recording apparatuses having the structures explained with reference to FIGS. 1 to 3 and FIG. 5. Next, a float for detecting specific-gravity (solid-state member) is made by using a ferrite-dispersed fluororesin (specific gravity: 1.08), and placed in the wasteink tank. Then, solid images are printed. When the ink, ejected from the ink cartridge through a recording head, has been accumulated in the waste-ink tank as waste ink, the float for detecting specific-gravity is allowed to float on the liquid surface of the accumulated waste ink. The positional information of the float for detecting specific-gravity is detected, and a diluent is supplied from the diluent tank until the float has been submerged to a predetermined position (specific gravity: 1.07). Then, the waste ink (reuse ink) which has been diluted is again returned to the ink tank so as to be reused.

Example 4

The ink (2) used in Example 2 is prepared, and the specific gravity thereof is measured and determined to be 1.04. When the content of water is made approximately one half (from about 60 parts by mass to about 30 parts by mass), the specific gravity of the ink having the above-mentioned components becomes 1.18.

An ink cartridge is filled with the ink (2), and this ink cartridge is attached to each of the ink jet recording apparatuses having the structures explained with reference to FIGS. 1 to 3 and FIG. 5. Next, a float for detecting specific-gravity (solid-state member) is made by using a ferrite-dispersed fluororesin (specific gravity: 1.05), and placed in the waste-ink tank. Then, solid images are printed. When the ink, ejected from the ink cartridge through a recording head, has been accumulated in the waste-ink tank as waste ink, the float for detecting specific-gravity is allowed to float on the liquid surface of the accumulated waste ink. The positional information of the float for detecting specific gravity is detected, and a diluent is supplied from the diluent tank until the float has been submerged to a predetermined position (specific gravity: 1.05) in the waste ink. Then, the waste ink (reuse ink) which has been diluted is again returned to the ink tank so as to be reused.

Example 5

The same processes as those of Example 1 are carried out except that, after the diluent has been supplied from the diluent tank, the stirring member is rotated, and solid images are printed.

Example 6

The same processes as those of Example 1 are carried out except that, after a diluent has been supplied from the diluent tank, the float for detecting specific gravity is rotated as the stirring member, and solid images are printed.

Comparative Example 1

The same processes as those of Example 1 are carried out except that ink in the waste-ink tank is not reused, and solid images are printed.

Comparative Example 2

The same processes as those of Example 2 are carried out except that ink in the waste-ink tank is not reused, and solid images are printed.

[Evaluation]

In each of Examples 1 to 6 as well as Comparative Examples 1 and 2, solid images, printed on regular paper (C2 paper: manufactured by Xerox Corporation), are subjected to on image density measurements at three positions within the same solid image by using an X-Rite 404 (manufactured by X-Rite Co., Ltd.).

(1) Image Unevenness

A With respect to image densities at the three positions, the difference between the greatest value and the smallest value is less than 0.03

B With respect to image densities at the three positions, the difference between the greatest value and the smallest value is not less than 0.03.

(2) Image Quality

The average value of the image densities of the three positions is obtained and evaluated.

TABLE 1

| | Image Unevenness | Image Quality |
|---|---|---|
| Example 1 | A | 0.78 |
| Example 2 | A | 1.13 |
| Example 3 | A | 0.76 |
| Example 4 | A | 1.13 |
| Example 5 | A | 0.77 |
| Example 6 | A | 1.13 |
| Comparative Example 1 | B | 0.82 |
| Comparative Example 2 | B | 1.21 |

Table 1 shows that the image unevenness of any one of Examples 1 to 6 is less than the image unevenness of Comparative Examples 1 and 2, and makes it possible to carry out sufficient printing operations in practical use. In other words, even when the waste ink is reused by using the present invention, a superior image quality can be obtained. In particular, in Examples 5 and 6 in which the waste ink is diluted and then stirred, the superior image quality is obtained. This is presumably because the dispersing property of the pigment is improved through the stirring process.

Additionally, the present invention also includes the following embodiments.

An ink jet recording apparatus in which the conductivity of the waste ink in the wasteink tank to which the diluent has been supplied is within a range of ±0.02 S/m relative to the conductivity of the ink in the ink tank.

An ink jet recording apparatus in which the specific gravity of the waste ink in the wasteink tank to which the diluent has been supplied is within a range of ±0.03 relative to the specific gravity of the ink in the ink tank.

An ink jet recording apparatus in which a second recording head that is different from the aforementioned recording head is attached to the waste-ink tank such that the waste ink in the wasteink tank is supplied to the recording head.

An ink jet recording apparatus in which a stirring member, which is driven in accordance with externally inputted instructions, is placed in the waste-ink tank and/or the ink tank.

An ink jet recording apparatus in which the ink tank and the recording head portion are formed integrally.

An ink jet recording apparatus in which the diluent is water and/or a volatile organic solvent having a vapor pressure at 25° C. of not less than 2.66 kPa.

An ink jet recording apparatus in which the second diluent supplier includes a specific-gravity detector for detecting the specific gravity of the waste ink in the waste-ink tank; the waste-ink tank includs a solid-state member that floats in the waste-ink tank; and the specific-gravity detector detects the position of the solid-state member and determines the specific gravity of the waste ink based on the position of the solid-state member.

An ink jet recording apparatus in which the solid-state member is driven within the waste-ink tank in accordance with externally inputted instructions.

What is claimed is:

1. An ink jet recording apparatus comprising:

a recording head that ejects ink droplets;

an ink tank that supplies ink to the recording head;

a waste ink recovering mechanism that recovers ink droplets ejected from the recording head as waste ink;

a waste-ink tank which is connected to the waste ink recovering mechanism and stores the waste ink;

a diluent tank which is communicated with the waste-ink tank and accommodates a diluent that dilutes the waste ink; and at least one diluent supplier selected from a first diluent supplier which supplies the diluent in the diluent tank to the waste-ink tank to make conductivity of the waste ink in the waste-ink tank substantially the same as the conductivity of the ink stored in the ink tank and a second diluent supplier which supplies the diluent in the diluent tank to the waste-ink tank to make specific gravity of the waste ink in the waste-ink tank substantially the same as the specific gravity of the ink stored in the ink tank.

2. The ink jet recording apparatus according to claim 1, wherein the conductivity of the waste ink in the waste-ink tank to which the diluent has been supplied is within a range of ±0.02 S/m with respect to the conductivity of the ink in the ink tank.

3. The ink jet recording apparatus according to claim 1, wherein the specific gravity of the waste ink in the waste-ink tank to which the diluent has been supplied is within a range of ±0.03 with respect to the specific gravity of the ink in the ink tank.

4. The ink jet recording apparatus according to claim 1, wherein a second recording head separate from the recording head of claim 1 is attached to the waste-ink tank such that the waste ink in the waste-ink tank is supplied to the second recording head.

5. The ink jet recording apparatus according to claim 1, wherein a stirring member, which is driven in accordance with externally inputted instructions, is placed in the waste-ink tank and/or the ink tank.

6. The ink jet recording apparatus according to claim 1, wherein the ink tank and a recording head portion are formed integrally.

7. The ink jet recording apparatus according to claim 1, wherein the diluent is water and/or a volatile organic solvent having a vapor pressure at 25° C. of not less than 2.66 kPa.

8. The ink jet recording apparatus according to claim 1, wherein: the second diluent supplier includes a specific-gravity detector for detecting the specific gravity of the waste ink in the waste-ink tank; the waste-ink tank includes a solid-state member that floats in the waste-ink tank; and the specific-gravity detector detects the position of the solid-state member and determines the specific gravity of the waste ink based on the position of the solid-state member.

9. The ink jet recording apparatus according to claim 8, wherein the solid-state member is driven in the waste-ink tank in accordance with externally inputted instructions.

10. An ink jet recording method comprising the steps of:

providing an ink jet recording apparatus including:

an ink tank that supplies ink to the recording head;

a waste ink recovering mechanism that recovers ink droplets ejected from the recording head as waste ink;

a waste-ink tank which is connected to the waste ink recovering mechanism and stores the waste ink;

a diluent tank which is communicated with the waste-ink tank and accommodates a diluent that dilutes the waste ink; and at least one diluent supplier selected from a first diluent supplier which supplies the diluent in the diluent tank to the waste-ink tank to make conductivity of the waste ink in the waste-ink tank substantially the same as the conductivity of the ink stored in the ink tank and a second diluent supplier which supplies the diluent in the diluent tank to the waste-ink tank to make specific gravity of the waste ink in the waste-ink tank substantially the same as the specific gravity of the ink stored in the ink tank;

recovering the waste ink into the waste-ink tank;

supplying the diluent in the diluent tank to the waste-ink tank to make the conductivity of the waste ink in the waste-ink tank substantially the same as the conductivity of the ink stored in the ink tank by using the first diluent supplier; and/or supplying the diluent in the diluent tank to the waste-ink tank to make the specific gravity of waste ink in the waste-ink tank substantially the same as the specific gravity of the ink stored in the ink tank by using the second diluent supplier.

11. The ink jet recording method according to claim 10, wherein the conductivity of the waste ink in the waste-ink tank to which the diluent has been supplied is within a range of ±0.02 S/m with respect to the conductivity of the ink in the ink tank.

12. The ink jet recording method according to claim 10, wherein the specific gravity of the waste ink in the waste-ink tank to which the diluent has been supplied is within a range of ±0.03 with respect to the specific gravity of the ink in the ink tank.

13. The ink jet recording method according to claim 10, wherein a second recording head separate from the recording head of claim 10 is attached to the waste-ink tank such that the waste ink in the waste-ink tank is supplied to the second recording head.

14. The ink jet recording method according to claim 10, wherein a stirring member, which is driven in accordance with externally inputted instructions, is placed in the waste-ink tank and/or the ink tank.

15. The ink jet recording method according to claim 10, wherein the ink tank and a recording head portion are formed integrally.

16. The ink jet recording method according to claim 10, wherein the diluent is water and/or a volatile organic solvent having a vapor pressure at 25° C. of not less than 2.66 kPa.

17. The ink jet recording method according to claim 10, wherein: the second diluent supplier includes a specific-gravity detector for detecting the specific gravity of the waste ink in the waste-ink tank; the waste-ink tank includes a solid-state member that floats in the waste-ink tank; and the specific-gravity detector detects the position of the solid-state member and determines the specific gravity of the waste ink based on the position of the solid-state member.

18. The ink jet recording method according to claim 17, wherein the solid-state member is driven in the waste-ink tank in accordance with externally inputted instructions.

* * * * *